United States Patent [19]

Berg et al.

[11] Patent Number: 5,036,366

[45] Date of Patent: Jul. 30, 1991

[54] LIQUID INK METERING ROLL

[75] Inventors: Eric Berg, Chadds Ford; Edward B. Caruthers, Jr., West Chester, both of Pa.

[73] Assignee: Xerox Corporation, Stamford, Conn.

[21] Appl. No.: 462,168

[22] Filed: Jan. 8, 1990

[51] Int. Cl.[5] ..... G03G 15/10

[52] U.S. Cl. ..... 355/256; 118/652; 118/100; 118/112

[58] Field of Search ..... 355/256; 118/659–662, 118/652, 100, 107, 110, 112, 114

[56] References Cited

U.S. PATENT DOCUMENTS

| | | | |
|---|---|---|---|
| 3,663,219 | 5/1972 | Takahashi | 355/256 X |
| 4,161,361 | 7/1979 | Soma et al. | 355/256 |
| 4,181,094 | 1/1980 | Gardiner | 355/256 X |
| 4,637,708 | 1/1987 | Yuasa . | |
| 4,728,991 | 3/1988 | Takayama et al. . | |

*Primary Examiner*—Joan H. Pendegrass

*Attorney, Agent, or Firm*—H. Fleischer; J. E. Beck; R. Zibelli

[57] ABSTRACT

A printing machine in which an image recorded on an electrostatic master is developed with liquid developer material and the excess liquid developer material eliminated therefrom. A meniscus is formed between a roll and the electrostatic master. The roll is adapted to remove the excess liquid developer material from the developed image. The meniscus is formed by electrically biasing the roll as the roll moves from a non-operative position remote from the electrostatic master to an operative position adjacent thereto.

15 Claims, 3 Drawing Sheets

LIQUID INK METERING ROLL

This invention relates generally to a printing system in which a liquid image is transferred to a copy sheet, and more particularly concerns an apparatus for eliminating excess liquid developer material from a developed image.

There are different printing processes which employ a moving master for transferring an image to a sheet of paper. One such technique is used to produce multiple color proof copies from halftone film separations. Initially, an electrostatic master is exposed to a halftone film separation. This forms a photochemical latent image on the master corresponding to the halftone film separation. Four masters are made. One of the masters corresponds to black with the other masters corresponding typically to the subtrative primary colors of the desired proof copy. The masters are then placed in the printing machine and secured to rotating cylinders. One master is mounted releasably on each cylinder. Each master is charged to a substantially uniform potential. The charge bleeds away except in the image areas to form an electrostatic latent image thereon corresponding to the image areas of the halftone film separation. The latent image is developed by bringing a liquid developer material into contact therewith. The liquid developer material comprises a liquid carrier having pigmented particles dispersed therein. These latent images are developed with developer material having a color corresponding to the substractive primary color of the corresponding halftone film separation. Thereafter, the differently colored developed images are transferred from the master sheets to the copy sheet in superimposed registration with one another. Heat is then applied to permanently fuse the image to the copy sheet so as to form a color proof copy.

The printing system uses a roller to remove excess liquid developer material from the developed image. This avoids carryout of excess toner and contamination of the copy. Inorder to removes the excess liquid from the master, a meniscus is formed between the roll and master. It has been found that when a meniscus is not formed, drips of liquid developer material may be formed on the copy. Hereinbefore, the meniscus has been formed at the lead edge of the master by using tape between the master and the cylinders and a complex on-off reverse roll motor program to establish the meniscus at the lead edge of of the master. Thus, it is desirable to eliminate the tape on the back of the master or a raised portion of the cylinder, designed to narrow the gap between the lead edge of the master and the roll, and a program that maintains the roll stationary for about one second after it indexes from the non-operative position spaced from the master to the operative position adjacent the master. The tape on the back of the master increases costs and slows down operator preparation of the master. A raised portion on the cylinder also increases costs and may interfere with sheet and master registration. Maintaining the roll stationary requires that a separate reverse roll motor be used, or, at least a reverse roll clutch. Electrophotographic printing machines using liquid development systems frequently have a metering roll to remove excess fluid from a photocondcutive drum. Printing machines of the type are sold by Savin and Ricoh. These printing machines use a seamless photoconductive drum which permits the rotating metering roll to be positioned close to the photoconductive drum. This type of metering roll does not have difficulty in establishing a meniscus at the lead edge of the toned image, nor do the resulting images have drips running backward from the lead edge of the image. However, in a printing machine wherein a master is attached to a drum, the metering roll must avoid interference with the lead edge of the master and with the apparatus ataching the master to the drum. This requires that the metering roll be indexed from a non-operative position, spaced from the master, to an operative position, closely adjacent to the master, after the lead edge of the master has passed the metering roll position. In a system of the type, a finite amount of time is required to establish a liquid meniscus between the master and the metering roll. Until this meniscus is formed across the full width of the metering roll, there will be areas of the master from which excess liquid developer material is not removed. The following disclosures appear to disclose the use of voltage pulses for transfer and sheet stripping:

U.S. Pat. No. 4,637,708
Patentee: Yuasa
Issued: Jan. 20, 1987

U.S. Pat. No. 4,728,991
Patentee: Takayama et al.
Issued: Mar. 1, 1988

The relevant portions of the foregoing patents may be briefly summarized as follows:

U.S. Pat. No. 4,637,708 discloses voltages pulses to transfer a uniform layer of magnetic toner particles. High voltage pulses are selectively applied to a multi-stylus head in response to an image signal. As a result, toner particles are selectively transferred from a belt to paper to record the desired data thereon.

U.S. Pat. No. 4,728,991 describes applying voltage pulses to strip paper from a semiconducting drum after transfer. The paper having the toner transferred thereto is subjected to a separation corona discharge voltage which is a positive DC voltage superimposed over an AC voltage. This prevents re-transfer of the toner to the drum.

Pursuant to the features of the present invention, there is provided an apparatus for eliminating excess liquid developer material from a developed image. The apparatus includes means, movable between a non-operative position, remote from the developed image, and an operative position, closely adjacent the developed image, for removing the excess liquid developer material from the developed image. Means are provided for forming a meniscus of liquid developer material between the developed image and the removing means as the removing means moves from the non-operative position to the operative position.

In accordance with another aspect of the present invention, there is provided a printing machine of the type in which an image recorded on an electrostatic master is developed with a liquid developer material with the excess liquid developer material being eliminated from the developed image. The improvement includes means, movable between a non-operative position, remote from the electrostatic master, and an operative position, closely adjacent the electrostatic master, for removing the excess liquid developer material from the developed image. Means are provided for forming a meniscus of liquid developer material between the developed image and the removing means as the removing means moves from the non-operative position to the operative position.

Other aspects of the present invention will become apparent as the following description proceeds and upon reference to the drawings, in which.

While the present invention will hereinafter be described in connection with a preferred embodiment thereof, it will be understood that it is not intended to limit the invention to that embodiment. On the contrary, it is intended to cover all alternatives, modifications and equivalents as may be included within the spirit and scope of the invention as defined by the appended claims.

Figure 1:
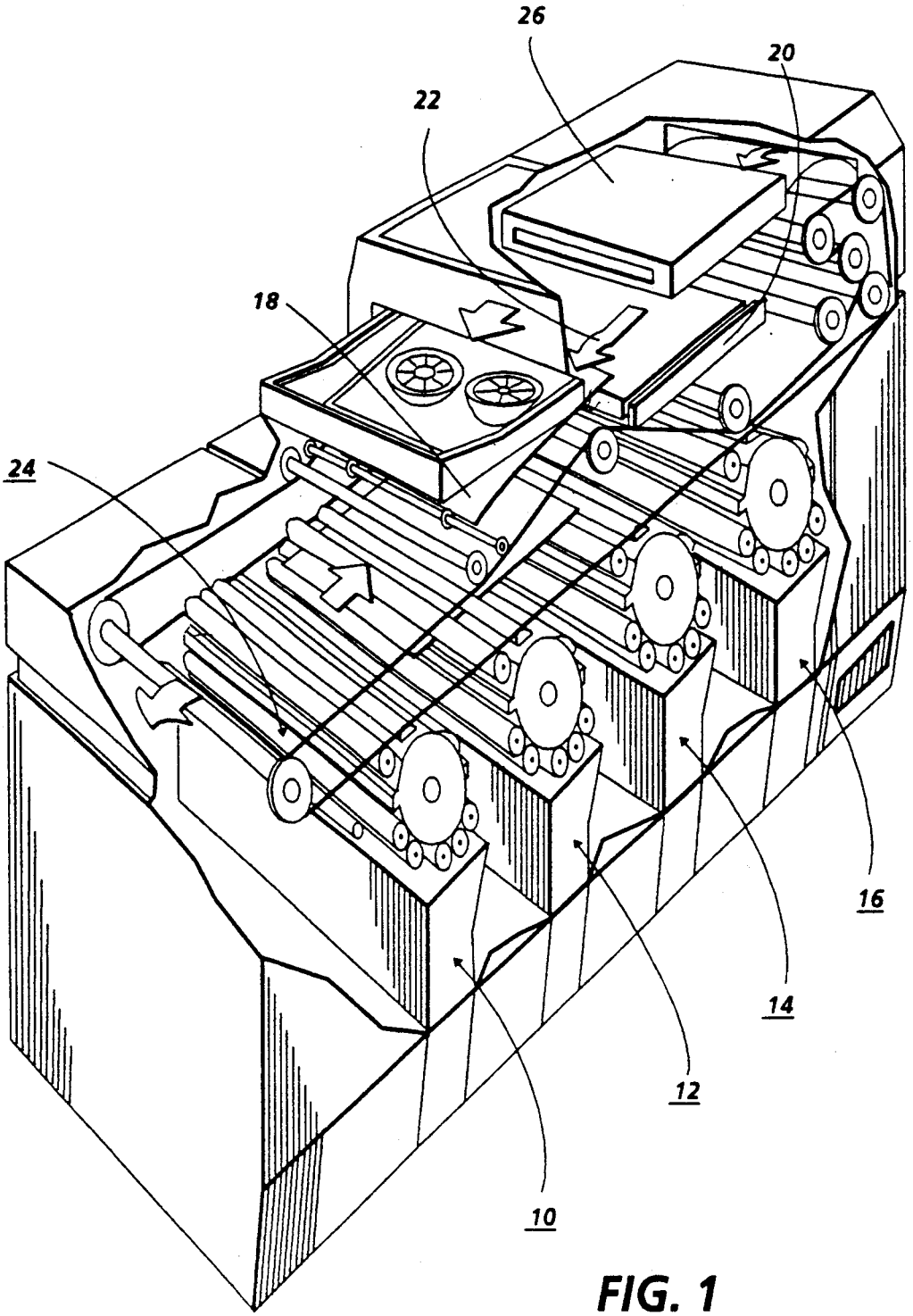
FIG. 1 is a schematic, perspective view showing an illustrative printing machine incorporating the features of the present invention therein.

For a general understanding of the features of the present invention, reference is made to the drawings. In the drawings, like reference numerals have been used throughout to designate identical elements. FIG. 1 schematically depicts the various components of an illustrative printing machine incorporating the apparatus of the present invention therein. It will become evident from the following discussion that the present invention is equally well suited for use in a wide variety of printing machines using a liquid developer material, and is not necessarily limited in its application to the particular printing machine shown herein.

Turning now to FIG. 1, the printing machine employs four printing modules, indicated generally by the reference numerals 10, 12, 14, and 16. Each printing module is substantially identical to one another with the only distinction being the color of the developer material. Printing module 10 employs a yellow liquid developer material, printing module 12 a magenta liquid developer material, printing module 14 a cyan liquid developer material, and printing module 16 a black liquid developer material. In operation, a discrete master sheet is formed for each printing module. This is achieved by exposing the master sheet to a halftone film separation. The halftone film separation is a negative corresponding typically to a subtractive primary color of the desired color proof. This records the desired color proof on the master sheet. The master sheet has a photopolymer layer coated on a metalized base and protected with a thin cover sheet. One skilled in the art will appreciate that any other suitable master sheet may also be employed. A contact exposure is made through the halftone film with a high intensity ultraviolet light. In the image areas, the polymerized area of the master sheet becomes an insulator to electric charge. The unexposed polymer retains its conductive properties. After exposure, the cover sheet is removed from the master sheet. The master sheets are then taken to the printing machine and loaded onto the drum of the appropriate printing module.

With continued reference to FIG. 1, after the master sheets are loaded in their respective printing modules, the printing machine is actuated to print the color proof. Upon energization of the printing machine, a sheet of support material 18 is advanced from tray 20. The sheet of support material may be made from any suitable material. Typically, however, it is made from plain paper. A sheet feeder separates and advances the uppermost sheet from a stack of sheets in tray 20. The sheet moves in the direction of arrow 22 to a transport, indicated generally by the reference numeral 24. Preferably, transport 24 includes a pair of parallel, spaced chains entrained about spaced sprockets which advance a gripper in a recirculating path. A servo motor rotates one of the sprockets to advance the chains in the direction of arrow 22. The lead edge of the sheet is secured releasably to the gripper and moves in unison therewith. In this way, transport 24 advances the sheet to successive printing modules. The master sheet, in each printing module, is developed with a different color liquid developer material. The differently colored developed images on each master sheet are transferred to sheet 18 in superimposed registration with one another to form a multicolor image thereon. Inasmuch as the printing modules are substantially identical to one another, only printing module 10 will be described in detail hereinafter with reference to FIG. 2. After all of the developed images have been transferred to sheet 18, transport 24 advances sheet 18 through fuser 26. Fuser 26 radiantly heats the sheet having the liquid images transferred thereto. The fuser supplies sufficient heat to dry and permanently affix the transferred image to sheet 18 forming the desired color proof. After fusing, the completed color proof is advanced to a tray for subsequent removal from the printing machine by the operator.

Figure 2:
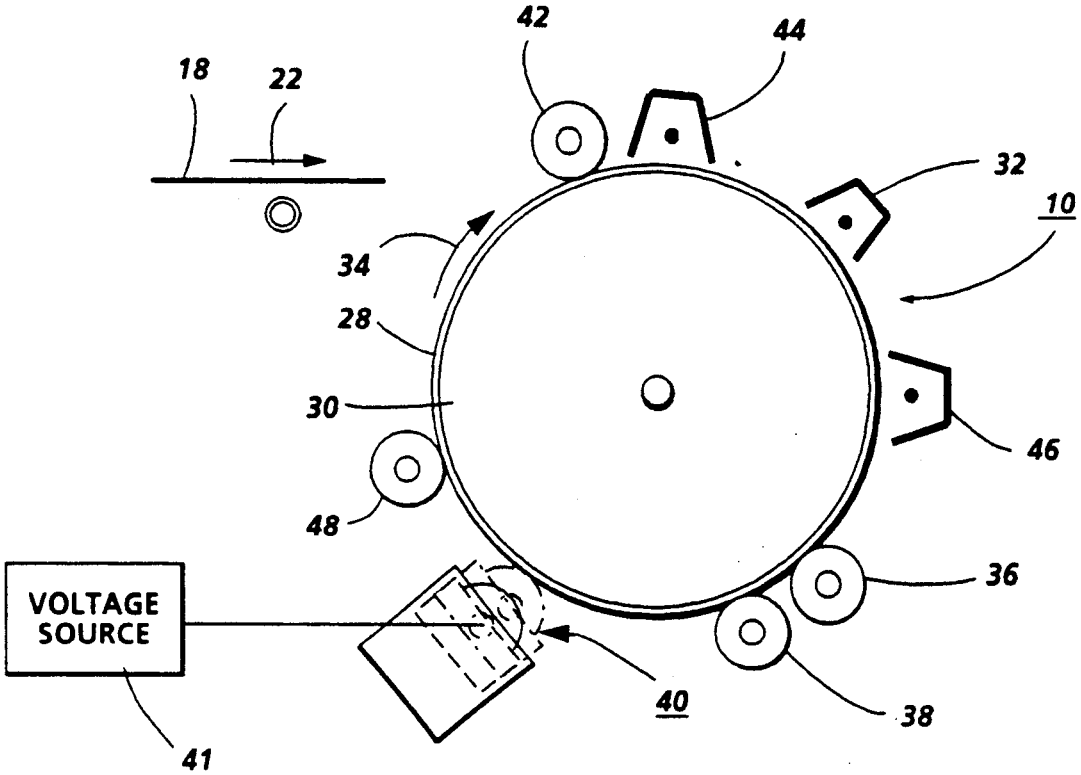
FIG. 2 is a schematic, elevational view depicting one of the printing modules used in the FIG. 1 printing machine.

Turning now to FIG. 2, there is shown further details of printing module 10. As shown thereat, a master sheet 28 is secured releasably to drum 30. During the first cycle, a corona generating device, indicated generally by the reference numeral 32, charges the master sheet 28 to a relatively high, substantially uniform potential. As drum 30 rotates master sheet 28 in the direction of arrow 34, the charge bleeds away from the master sheet, except in the image areas. Next, developer rolls 36 and 38 advance yellow liquid developer material into contact with master sheet 28. The yellow liquid developer includes a clear carrier and yellow colored toner. In this way, liquid developer material is brought into contact with the image areas and test area formed on the master sheet. Developer material is attracted electrostatically to the image areas forming a yellow liquid image on master sheet 28. Preferably, the developer material includes a clear liquid insulating carrier having pigmented particles, i.e. toner particles, dispersed therein. A suitable clear insulating liquid carrier may be made from an aliphatic hydrocarbon, such as an Isopar, which is a trademark of the Exxon Corporation, having a low boiling point. The toner particles include a pigment associated with a polymer. An example of a suitable liquid developer material is described in U.S. Pat. No. 4,582,774, issued to Landa in 1986, the relevant portions thereof being incorporated into the present application. A roll 40 controls the quantity of developer material deposited on master sheet 28 and removes the excess therefrom. The roll 40 is indexed from a non-operative position remote from master sheet 28 to an operative position closely adjacent to master sheet 28. A voltage source 41 electrically biases roll 40 so that a meniscus forms between the developed image on master sheet 28 and roll 40. Voltage source 41 applies a short pulse of high voltage to roll 40 to attract toner particles from the master sheet 28 to roll 40 to establish the meniscus. The voltage is positive so that it removes negatively charged toner particles from the fluid. The pulse is turned on as the roll moves from the non-operative position to the operative position and is energized for a sufficiently long duration for the meniscus to form across the entire length of roll 40. After the meniscus is formed across the entire length of roll 40, the voltage applied to roll 40 is reduced to the value normally used to avoid background. Further details of the manner in which roll 40 is operated and the pulse of high voltage applied thereon will be described hereinafter with reference to FIGS. 3 and 4.

After the excess liquid developer is removed from master sheet 28, drum 30 rotates the developed liquid image to the transfer station. Copy sheet 18 is advanced to the transfer station in synchronism with the developed liquid image on master sheet 28. The transfer station has an electrically biased roll 42 and corona generator 44. Sheet 18 is interposed between master sheet 28 and roll 42. Thereafter, transport 24 interposes sheet 18 between corona generator 44 and master sheet 28. Roll 42 is electrically biased to a suitable magnitude and polarity to tack sheet 18 to master sheet 28. Corona generator 44 sprays ions onto the backside of sheet 18 to attract the developed liquid image from master sheet 28 thereto. After the developed image has been transferred to sheet 18, the master sheet passes through the next cycle, i.e. a cleaning cycle, and sheet 18 advances to the next printing module. During the first cycle, corona generator 46 and cleaning roll 48 are non-operative. In contradistinction, corona generator 46 and cleaning roll 48 are operative during this cleaning cycle with corona generators 32 and 44, developer rolls 36 and 38, and roll 40 being non-operative. During this cycle, roll 40 has moved from the operative position to the non-operative position. Corona generator 46 sprays ions onto master sheet 28 to neutralize the charge thereon. Cleaning roller 48 scrubs the surface of master sheet 28 clean. To assist in this action, liquid carrier may be fed onto the surface of cleaning roller 48. Preferably, the cleaning fluid is the carrier of the liquid developer material, i.e. a clear low boiling point aliphatic hydrocarbon, such as an Isopar, which is a trademark of the Exxon Corporation.

Figure 3:
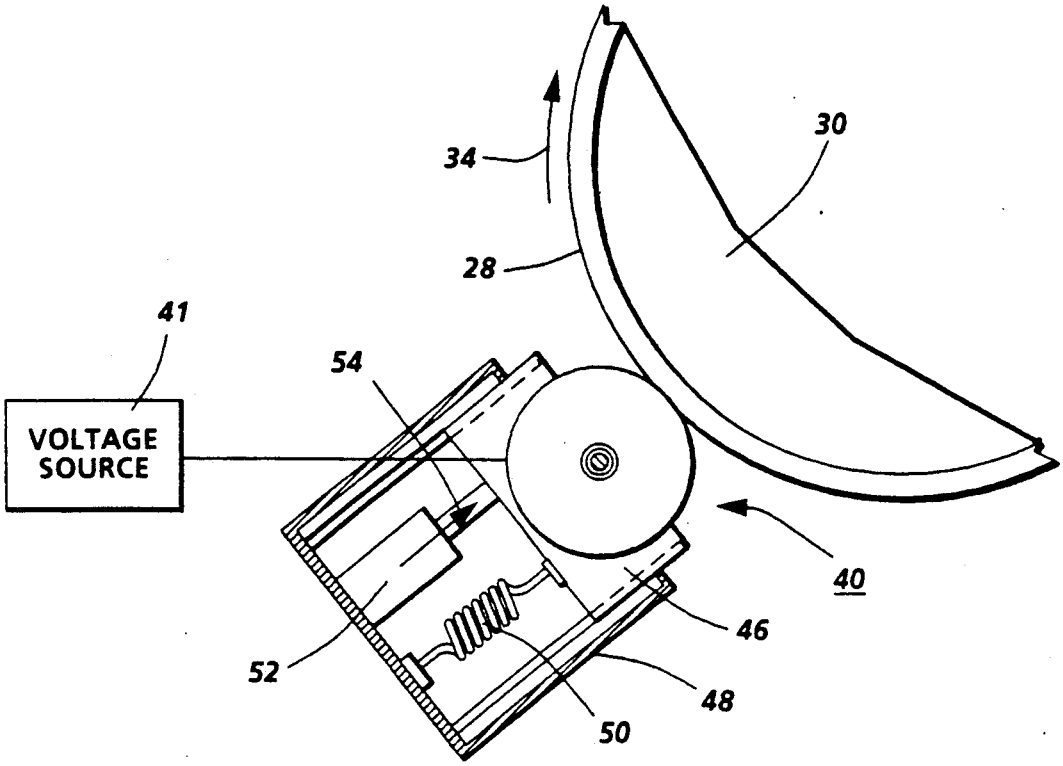
FIG. 3 is a schematic elevational view showing the FIG. 2 roller for removing excess liquid developer material from the electrostatic master.
Figure 4:
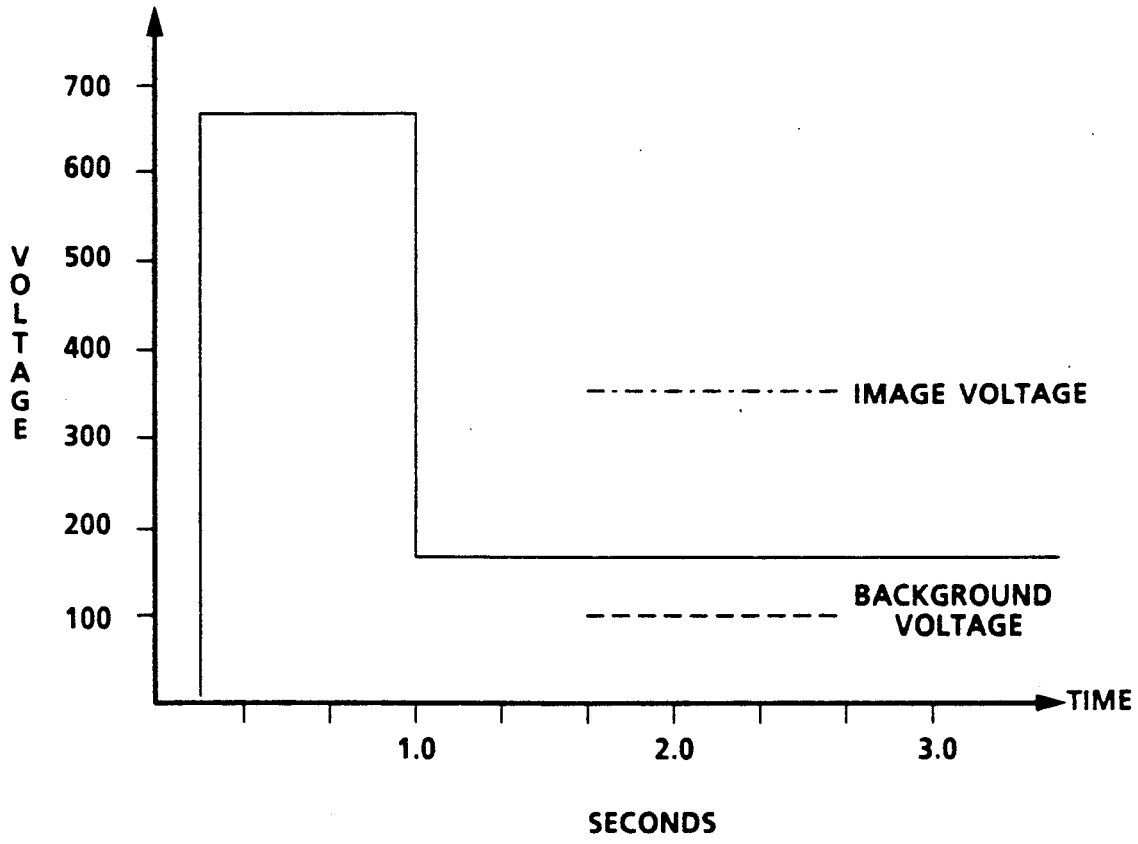
FIG. 4 is a graph depicting the voltage pulse applied on the FIG. 3 roller.

Referring now to FIG. 3, roll 40 is mounted rotatably on frame 46 and is adapted to rotate in the opposite direction to that of arrow 34. Frame 46 is mounted slidably in housing 48. Voltage source 41 is electrically connected to roll 40. Spring 50 resiliently urges frame 46 to slide in housing 48 in a direction away from drum 30. Energization of solenoid 52 slides frame 46, in the direction of arrow 54, toward drum 30. In operation, when solenoid 52 is de-energized, spring 50 slides frame 46 away from drum 30 to position roll 40 in the non-operative position remote from master sheet 28. When solenoid 52 is energized, frame 46 slides, in the direction of arrow 54, toward drum 30, to position roll 40 in the operative position adjacent master sheet 28. Voltage source 41 is energized substantially simultaneously with the energization of solenoid 52. In this way, a pulse of high voltage is applied to roll 40 as solenoid 52 is energized to move roll 40 toward master sheet 28. This forms a liquid meniscus between roll 40 and master sheet 28. FIG. 4 is a diagram of the voltage applied on roll 40 versus time inorder to establish the meniscus.

Turning now to FIG. 4, a pulse of about 650 volts is applied for about 1 second to roll 40. Thereafter, the voltage applied on roll 40 is reduced to a constant voltage at an intermediate level between the background voltage level and the image voltage level on master sheet 28. As shown, the background voltage is about 100 volts and the image voltage is about 350 volts. Under these circumstances, the voltage applied to roll 40 is reduced from about 650 volts to about 150 volts after about 1 second. An AC voltage can be added to the normal DC voltage electrically biasing roll 40. This AC voltage also helps to establish the meniscus and does not have to be turned off. By way of example, an AC voltage of about 300 volts at 200 Hertz or 500 Hertz may be superimposed over the DC voltage. In either case, it is the electric field attraction for the liquid developer which establishes the liquid meniscus between the master sheet and the roll.

The advantages of a system of the type described herein is that the indexing of the metering roll avoids interference with the lead edge of the master and the apparatus securing the master to the drum, and the addition of the electrical field pulse attracts the liquid developer material to the metering roll and substantially shortens the time required to form a liquid meniscus across the full width of the gap between the master and the metering roll.

One skilled in the art will appreciate that while this invention has been disclosed as being used in an electrophotocgraphic printing machine, it may be used in any coating operation. The combination of an indexing metering roll and a brief electrical field pulse is useful in establishing a meniscus in other coating operations, e.g. coating papers and films, and that this invention will reduce scrap at the leading edge of the coating operation.

In recapitulation, the roll of the present invention eliminates excess liquid developer material from a developed image without dripping on the copy. This is achieved by electrically biasing the roll with a short pulse of high voltage as the roll moves from a non-operative position, remote from the developed image, to an operative position, closely adjacent thereto. As the roll moves toward the developed image, a meniscus of liquid developer material is formed between the developed image and the roll.

It is, therefore, evident that there has been provided in accordance with the present invention, an apparatus that fully satisfies the aims and advantages hereinbefore set forth. While this invention has been described in conjunction with a specific embodiment thereof, it is evident that many alternatives, modifications and variations will be apparent to those skilled in the art. Accordingly, it is intended to embrace all such alternatives, modifications and variations as fall within the spirit and broad scope of the appended claims.

What is claimed is:

1. An apparatus for eliminating excess liquid developer material from a developed image, including:

means, movable between a non-operative position, remote from the developed image, and an operative position, closely adjacent the developed image, for removing the excess liquid developer material from the developed image; and means for applying an electrical bias to said removing means as said removing means moves from the non-operative position to the operative position to attract liquid developer material from the developed image to said removing means.

2. An apparatus according to claim 1, wherein said electrical biasing means applies a pulse voltage to said removing means.

3. An apparatus according to claim 2, wherein the pulse voltage applied by said electrical biasing means is a DC voltage.

4. An apparatus according to claim 2, wherein the pulse voltage applied by said electrical biasing means is a DC voltage having an AC voltage superimposed thereover.

5. An apparatus according to claim 2, wherein said removing means includes a roller.

6. A printing machine of the type in which an image recorded on an electrostatic master is developed with a liquid developer material with the excess liquid developer material being eliminated from the developed image, wherein the improvement includes:

means, movable between a non-operative position, remote from the electrostatic master, and an operative position, closely adjacent the electrostatic master, for removing the excess liquid developer material from the developed image; and means for applying an electrical bias to said removing means as said removing means moves from the non-operative position to the operative position to attract liquid developer material from the developed image to said removing means.

7. A printing machine according to claim 6, wherein said electrical biasing means applies a pulse voltage to said removing means.

8. A printing machine according to claim 7, wherein the pulse voltage applied by said electrical biasing means is a DC voltage.

9. A printing machine according to claim 7, wherein the pulse voltage applied by said electrical biasing means is a DC voltage having an AC voltage superimposed thereover.

10. A printing machine according to claim 7, wherein said removing means includes a roller.

11. An apparatus for eliminating excess liquid material coated on a surface, including:

means, movable between a non-operative position, remote from the surface, and an operative position, closely adjacent the surface, for removing the excess liquid material from the surface; and means for applying an electrical bias to said removing means as said removing means moves from the non-operative position to the operative position to attract liquid material from the liquid material coated on the surface to said removing means.

12. An apparatus according to claim 11, wherein said electrical biasing means applies a pulse voltage to said removing means.

13. An apparatus according to claim 12, wherein the pulse voltage applied by said electrical biasing means is a DC voltage.

14. An apparatus according to claim 13, wherein the pulse voltage applied by said electrical biasing means is a DC voltage having an AC voltage superimposed thereover.

15. An apparatus according to claim 13, wherein said removing means includes a roller.

* * * * *